US010591181B2

(12) United States Patent
Ishikawa et al.

(10) Patent No.: US 10,591,181 B2
(45) Date of Patent: Mar. 17, 2020

(54) INDOOR UNIT OF AIR-CONDITIONING DEVICE HAVING LOUVER WITH WATER ABSORBER

(71) Applicant: Mitsubishi Electric Corporation, Tokyo (JP)

(72) Inventors: Masato Ishikawa, Tokyo (JP); Akimoto Suzuki, Tokyo (JP); Masahide Kinami, Tokyo (JP); Kiyoshi Yasutomi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 10 days.

(21) Appl. No.: 15/765,598

(22) PCT Filed: Dec. 3, 2015

(86) PCT No.: PCT/JP2015/084077

§ 371 (c)(1),
(2) Date: Apr. 3, 2018

(87) PCT Pub. No.: WO2017/094174

PCT Pub. Date: Jun. 8, 2017

(65) Prior Publication Data

US 2019/0078804 A1 Mar. 14, 2019

(51) Int. Cl.
*F24F 13/14* (2006.01)
*F24F 13/22* (2006.01)

(52) U.S. Cl.
CPC ..... *F24F 13/14* (2013.01); *F24F 13/22* (2013.01)

(58) Field of Classification Search
CPC .. F24F 13/20; F24F 13/14; F24F 13/22; F24F 2013/221
See application file for complete search history.

(56) References Cited

FOREIGN PATENT DOCUMENTS

| | | | |
|---|---|---|---|
| JP | S64-053844 | U | 4/1989 |
| JP | H06-137660 | A | 5/1994 |
| JP | 2002-156130 | A | 5/2002 |
| JP | 2005-121306 | A | 5/2005 |
| JP | 2009-063275 | A | 3/2009 |

OTHER PUBLICATIONS

International Search Report of the International Searching Authority dated Mar. 1, 2016 for the corresponding International application No. PCT/JP2015/084077 (and English translation).
Office Action dated Apr. 9, 2019 issued in corresponding JP patent application No. 2017-553580 (and English translation).
Office Action dated Jul. 24, 2019 issued in corresponding CN patent application No. 201580057235.7 (and English translation).

*Primary Examiner* — Elizabeth J Martin
(74) *Attorney, Agent, or Firm* — Posz Law Group, PLC

(57) ABSTRACT

A highly reliable indoor unit of an air-conditioning apparatus prevents condensation water from dripping from an end portion of an up-down airflow direction louver on the downstream side of an airflow. There are provided a casing having an air inlet and an air outlet and including a heat exchanger and an air-sending fan inside the casing; and an up-down airflow direction louver that is disposed at the air outlet and controls the up-down direction of air from the air outlet. The airflow direction louver includes first and second plates joined together and a water absorber at an end portion of the airflow direction louver on the downstream side of the airflow that passes along the airflow direction louver. The water absorber is held between the first and second plates. A portion of the water absorber is exposed.

4 Claims, 5 Drawing Sheets

INDOOR UNIT OF AIR-CONDITIONING DEVICE HAVING LOUVER WITH WATER ABSORBER

CROSS REFERENCE To RELATED APPLICATION

This application is a U.S. national stage application of PCT/JP2015/084077 filed on Dec. 3, 2015, the contents of which are incorporated herein by reference.

TECHNICAL FIELD

The present invention relates to an indoor unit of an air-conditioning apparatus, the indoor unit including an up-down airflow direction louver that controls an up-down direction of air from an air outlet.

BACKGROUND ART

An indoor unit of an air-conditioning apparatus includes components, such as a heat exchanger and an air-sending fan, inside the indoor unit and also includes an up-down airflow direction louver that controls the blowing direction of heat-exchanged air.

While the air-conditioning apparatus is performing cooling operation, the up-down airflow direction louver is in contact with heat-exchanged cool air and with air that contains indoor moisture and is still warm. In the above circumstance, condensation due to a temperature difference easily occurs on the up-down airflow direction louver.

Therefore, an up-down airflow direction louver to which a thermal insulation material is bonded is known. A method of preventing condensation by causing cool air to flow along both sides of front and back surfaces of an up-down airflow direction louver is also known.

In addition, a technique that prevents condensation by thermal insulation by providing a hollow layer between two stacked components of an up-down airflow direction louver, which is divided into two as the two components at the front and the back, is known (refer to, for example, Patent Literature 1).

CITATION LIST

Patent Literature

Patent Literature 1: Japanese Unexamined Patent Application Publication No. 2009-63275

SUMMARY OF INVENTION

Technical Problem

In the technique in Patent Literature 1, the up-down airflow direction louver is divided into two as the front and back components, and the two components are stacked with the hollow layer provided therebetween for thermal insulation. Thus, even when heat-exchanged cool air is blown onto one surface of the up-down airflow direction louver, the other surface of the up-down airflow direction louver in contact with indoor air is not cooled.

However, there is a drawback in which condensation easily occurs due to the indoor air that comes into contact with an end portion of the up-down airflow direction louver on the downstream side of an airflow that passes along the up-down airflow direction louver.

To solve the above drawback, the present invention provides a highly reliable indoor unit of an air-conditioning apparatus that prevents condensation water from dripping from an end portion of an up-down airflow direction louver on the downstream side of an airflow.

Solution to Problem

An indoor unit of an air-conditioning apparatus according to an embodiment of the present invention includes a casing having an air inlet and an air outlet and including a heat exchanger and an air-sending fan disposed inside the casing; and an up-down airflow direction louver that is disposed at the air outlet and controls an up-down direction of air from the air outlet. The up-down airflow direction louver includes a first plate and a second plate joined to each other and includes a water absorber at an end portion of the up-down airflow direction louver on the downstream side of an airflow that passes along the up-down airflow direction louver. The water absorber is held between the first plate and the second plate. A portion of the water absorber is exposed.

Advantageous Effects of Invention

The indoor unit of the air-conditioning apparatus according to an embodiment of the present invention includes the water absorber at the end portion on the downstream side of the airflow that passes along the up-down airflow direction louver. The water absorber is held between the first plate and the second plate. The portion of the water absorber is exposed. Due to such a structure, even when condensation occurs on the end portion of the up-down airflow direction louver on the downstream side, condensation water can be retained by the water absorber and prevented from dripping in a room.

Moreover, because the water absorber is held between the first plate and the second plate, the water absorber does not come off from the up-down airflow direction louver, which leads to high durability and high reliability.

Therefore, it is possible to provide the highly reliable indoor unit of the air-conditioning apparatus that prevents condensation water from dripping from the end portion of the up-down airflow direction louver on the downstream side of the airflow.

DESCRIPTION OF EMBODIMENTS

Figure 1:
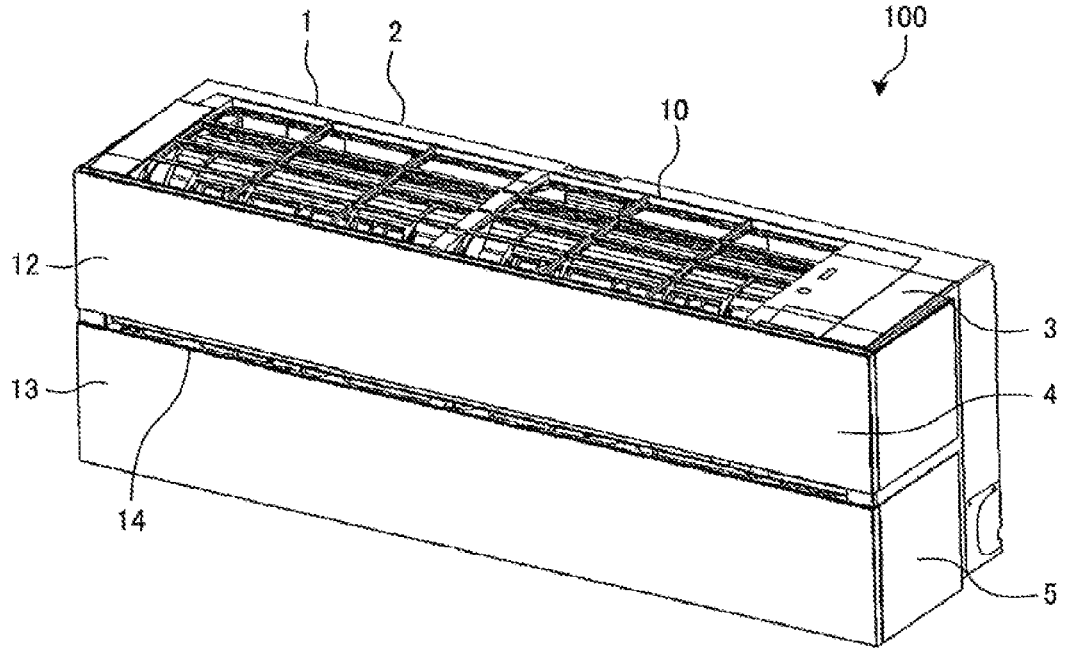
FIG. 1 is a top perspective view of an indoor unit of an air-conditioning apparatus according to Embodiment 1 of the present invention.

An embodiment of the present invention will be described below on the basis of the drawings.

It is to be noted that in the drawings, components that are given the same reference character are identical or correspond to each other; the same applies to the whole text of the description.

In addition, the form of each component described in the whole text of the description is merely an example, and the form of each component is not limited by these descriptions.

Embodiment 1

Figure 2:
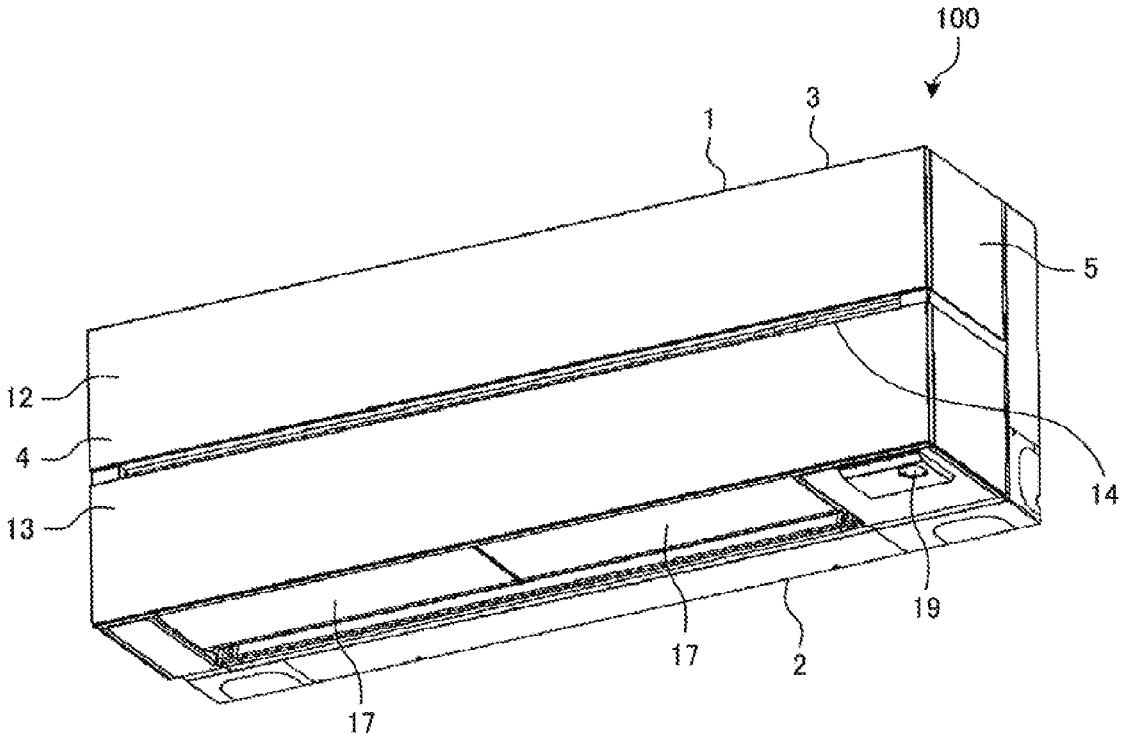
FIG. 2 is a bottom perspective view of the indoor unit of the air-conditioning apparatus according to Embodiment 1 of the present invention.
Figure 3:
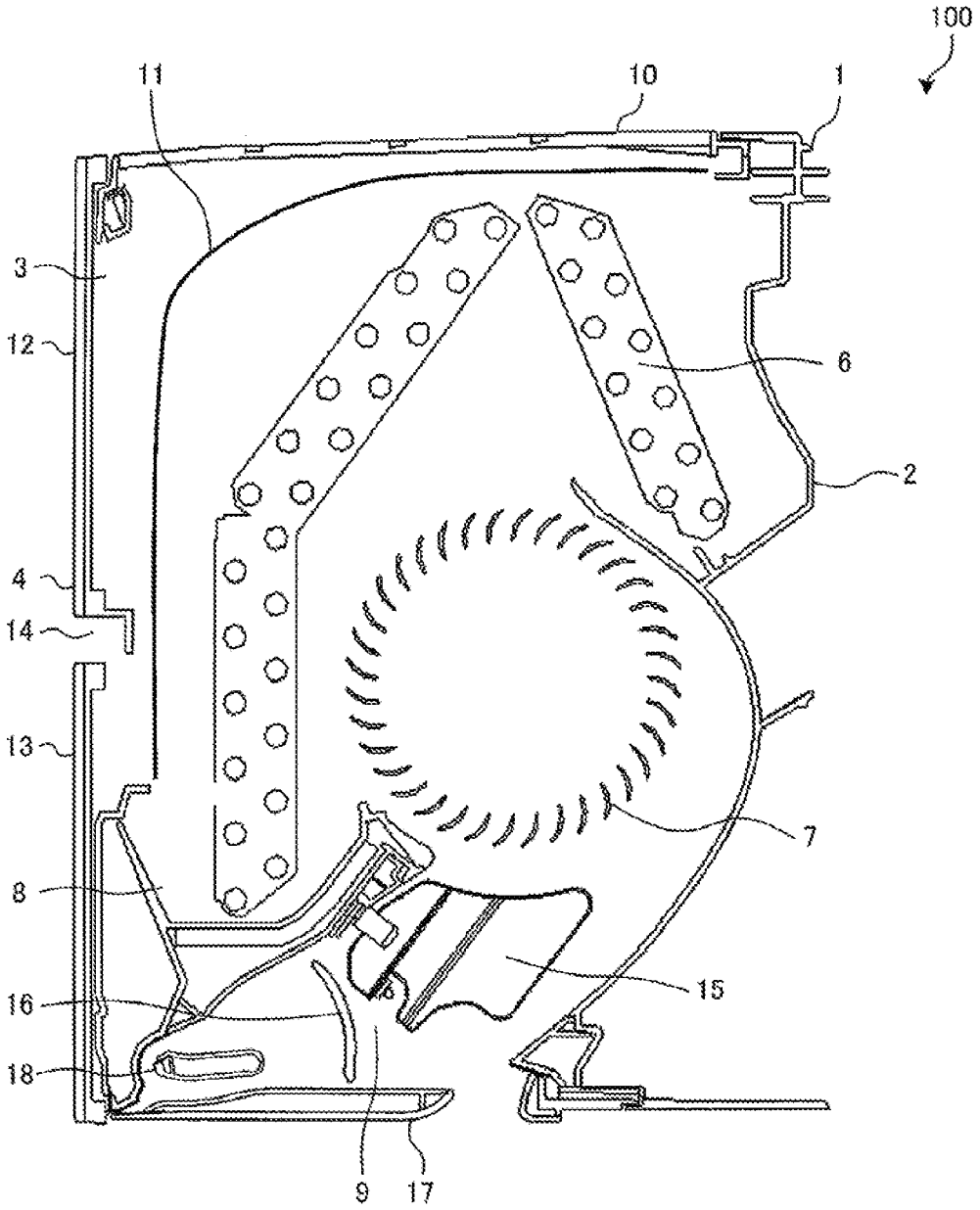
FIG. 3 is a sectional view of the indoor unit of the air-conditioning apparatus according to Embodiment 1 of the present invention during non-operation.
Figure 4:
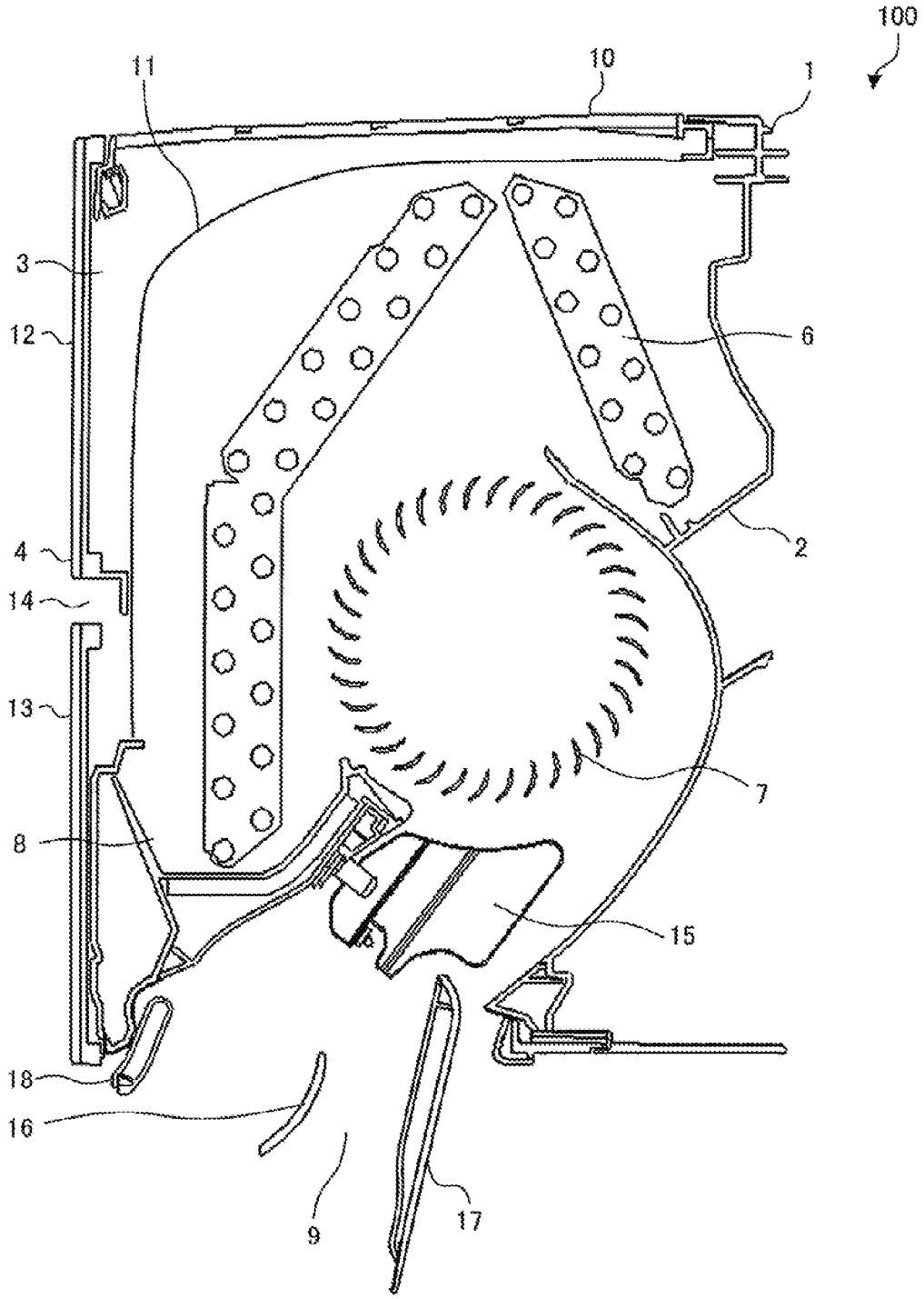
FIG. 4 is a sectional view of the indoor unit of the air-conditioning apparatus according to Embodiment 1 of the present invention during cooling operation.

FIG. 1 is a top perspective view of an indoor unit 100 of an air-conditioning apparatus according to Embodiment 1 of the present invention. FIG. 2 is a bottom perspective view of the indoor unit 100 of the air-conditioning apparatus according to Embodiment 1 of the present invention. FIG. 3 is a sectional view of the indoor unit 100 of the air-conditioning apparatus according to Embodiment 1 of the present invention during non-operation. FIG. 4 is a sectional view of the indoor unit 100 of the air-conditioning apparatus according to Embodiment 1 of the present invention during cooling operation.

The indoor unit 100 of the air-conditioning apparatus includes an inverter-driven compressor, a four-way valve, a condensation-side heat exchanger, a decompressor, and an evaporation-side heat exchanger, which are connected to each other. The inverter-driven compressor is controllable in terms of rotation speed. The indoor unit 100 is a wall-hung type indoor unit capable of performing cooling operation and heating operation by switching the four-way valve.

As illustrated in FIGS. 1 to 4, the indoor unit 100 of the air-conditioning apparatus includes a back surface case 2 constituting a casing 1 of the indoor unit 100, a front surface panel 3 constituting the casing 1 of the indoor unit 100, a suction grille 4 constituting the casing 1 of the indoor unit 100 and serving as an aesthetic surface, and side covers 5 constituting the casing 1 of the indoor unit 100.

A heat exchanger 6 having a bent shape, an air-sending fan 7 positioned downstream of an airflow of the heat exchanger 6, and an electrical item box (not shown) are attached to the back surface case 2. A drain pan 8 that receives condensation water from the heat exchanger 6 is disposed below the heat exchanger 6 on a front surface side. An air outlet 9 for blowing out heat-exchanged air is disposed below the air-sending fan 7.

The front surface panel 3 constitutes an upper surface portion and a front surface portion of the casing 1 of the indoor unit 100. An upper air inlet 10 is formed in an upper surface of the front surface panel 3. A filter 11 that covers top and front surfaces of the heat exchanger 6 is disposed inside the front surface panel 3. The filter 11 is arranged so as to surround the heat exchanger 6. The front surface panel 3 is fixed to the back surface case 2.

The suction grille 4 constitutes the front surface portion of the casing 1 of the indoor unit 100. The suction grille 4 includes an upper cover 12 positioned at an upper part of a front surface of the casing 1 and a lower cover 13 positioned at a lower part of the front surface of the casing 1. A horizontally extending gap between the upper cover 12 and the lower cover 13 serves as a front surface air inlet 14.

The indoor unit 100 of the air-conditioning apparatus includes a left-right airflow direction louver 15 that is disposed at the air outlet 9 and that controls the direction of air blown out from the air outlet 9 in terms of the left-right direction of a living space. The left-right airflow direction louver 15 may be separated into two as left and right sections to perform air-conditioning of two places. The left-right airflow direction louver 15 can be turned by a drive motor (not shown).

The indoor unit 100 of the air-conditioning apparatus includes a first up-down airflow direction louver 16, a second up-down airflow direction louver 17, and a third up-down airflow direction louver 18 that are disposed at the air outlet 9 and that control the direction of the air blown out from the air outlet 9 in terms of the up-down direction, which is the height direction of the living space.

The first up-down airflow direction louver 16 is formed of a curved plate member. The first up-down airflow direction louver 16 is positioned between the second up-down airflow direction louver 17 and the third up-down airflow direction louver 18 during operation. The second up-down airflow direction louver 17 is disposed on a back surface side of the air outlet 9. The third up-down airflow direction louver 18 is disposed on a front surface side of the air outlet 9. The third up-down airflow direction louver 18 is smaller than the second up-down airflow direction louver 17. Details of the structures of the second up-down airflow direction louver 17 and the third up-down airflow direction louver 18 will be described later. The first up-down airflow direction louver 16, the second up-down airflow direction louver 17, and the third up-down airflow direction louver 18 can be turned by the drive motor (not shown).

The indoor unit 100 of the air-conditioning apparatus suctions indoor air through the upper air inlet 10 and the front surface air inlet 14 by using the air-sending fan 7. The air suctioned into the indoor unit 100 is heat exchanged by the heat exchanger 6 and becomes cool air or warm air. The cool air or the warm air is blown into a room through the air outlet 9, at which the left-right airflow direction louver 15, the first up-down airflow direction louver 16, the second up-down airflow direction louver 17, and the third up-down airflow direction louver 18 are disposed.

At this time, the left-right airflow direction louver 15 turns to control the left-right direction of the heat-exchanged air blown by the air-sending fan 7. The first up-down airflow direction louver 16, the second up-down airflow direction louver 17, and the third up-down airflow direction louver 18 also turn to control the up-down direction of the heat-exchanged air blown by the air-sending fan 7.

The indoor unit 100 of the air-conditioning apparatus also includes an infrared sensor 19 that is positioned next to the air outlet 9 in the left-right direction and that measures a temperature of a floor, a temperature of a wall surface, a position of a human body, and an active state of the human body in the room.

It is to be noted that a structure that includes a cross flow fan, as the air-sending fan 7, on the downstream side of the heat exchanger 6 is described herein; however, the structure may include a different fan, for example, a propeller fan. In addition, the structure may include a different fan, for example, a propeller fan, on the upstream side of the heat exchanger.

Next, an outline of the structure of the second up-down airflow direction louver 17 and the third up-down airflow direction louver 18 will be described.

Figure 5:
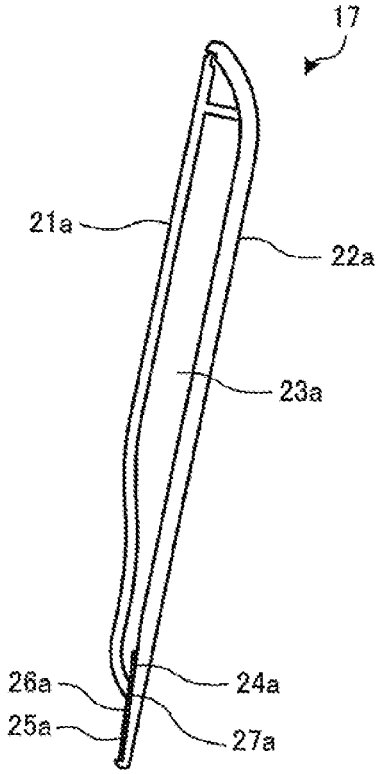
FIG. 5 is a sectional view of a second up-down airflow direction louver according to Embodiment 1 of the present invention.
Figure 6:
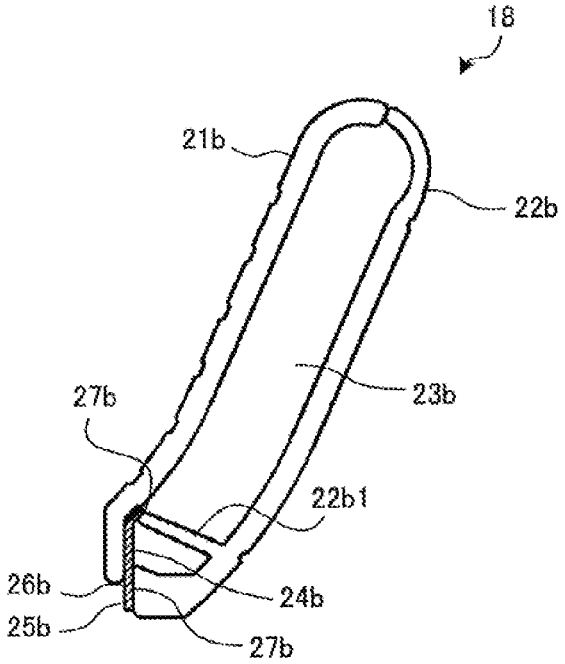
FIG. 6 is a sectional view of a third up-down airflow direction louver according to Embodiment 1 of the present invention.
Figure 7:
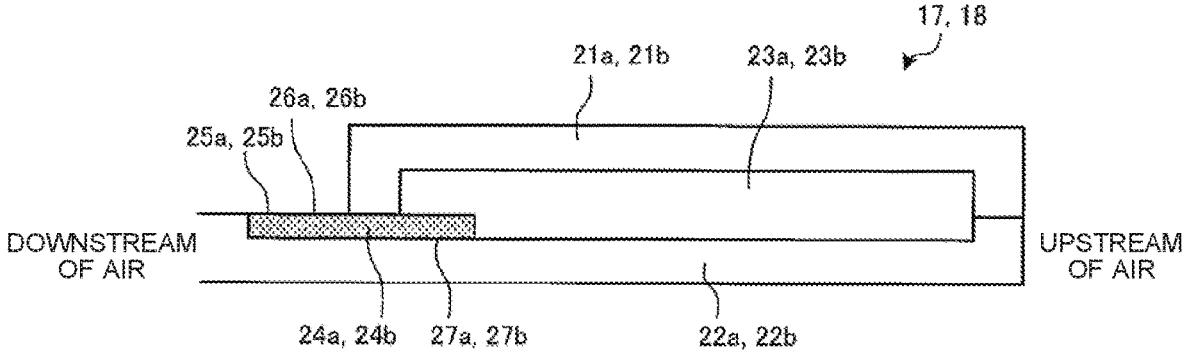
FIG. 7 illustrates an outline of the structure of the second up-down airflow direction louver and the third up-down airflow direction louver according to Embodiment 1 of the present invention.

FIG. 5 is a sectional view of the second up-down airflow direction louver 17 according to Embodiment 1 of the present invention. FIG. 6 is a sectional view of the third up-down airflow direction louver 18 according to Embodiment 1 of the present invention. FIG. 7 illustrates an outline of the structure of the second up-down airflow direction louver 17 and the third up-down airflow direction louver 18 according to Embodiment 1 of the present invention.

As illustrated in FIG. 7, the second up-down airflow direction louver 17 is formed by joining a first plate 21*a* and a second plate 22*a* to each other so as to be at the front and back, respectively, and the third up-down airflow direction louver 18 is formed by joining a first plate 21*b* and a second plate 22*b* to each other so as to be at the front and back, respectively. During operation, the first plate 21*a* is on the side of a front surface of the second up-down airflow direction louver 17, and the first plate 21*b* is on the side of a front surface of the third up-down airflow direction louver 18. During operation, the second plate 22*a* is on the side of a back surface of the second up-down airflow direction louver 17, and the second plate 22*b* is on the side of a back surface of the third up-down airflow direction louver 18. Hollow parts 23*a* and 23*b* are provided inside the second up-down airflow direction louver 17 and the third up-down airflow direction louver 18, respectively. The second up-down airflow direction louver 17 includes a water absorber 24*a* at an end portion thereof on the downstream side of an airflow that passes along the second up-down airflow direction louver 17, and the third up-down airflow direction louver 18 includes a water absorber 24*b* at an end portion thereof on the downstream side of an airflow that passes along the third up-down airflow direction louver 18. The water absorbers 24*a* and 24*b* are held between the first plate 21*a* and the second plate 22*a* and between the first plate 21*b* and the second plate 22*b*, respectively. Specifically, the water absorber 24*a* is held between an end surface at an end portion of the first plate 21*a* on the downstream side and a plate surface of the second plate 22*a*, and the water absorber 24*b* is held between an end surface at an end portion of the first plate 21*b* on the downstream side and a plate surface of the second plate 22*b*. The water absorber 24*a* is in a state of having an exposed portion 25*a*, where a portion of the water absorber 24*a* is exposed, and the water absorber 24*b* is in a state of having an exposed portion 25*b*, where a portion of the water absorber 24*b* is exposed.

A resin such as a PS resin or an ABS resin is used to mold the first plates 21*a* and 21*b* and the second plates 22*a* and 22*b*. The first plates 21*a* and 21*b* are joined to the second plates 22*a* and 22*b*, respectively, by using a catch (not shown) or by ultrasonic welding, heat welding, or other methods. The first plate 21*a* and the second plate 22*a* are not required to be in close contact with each other to cause the hollow part 23*a* to form a strong thermally insulated state, because the first and second plates 21*a* and 22*a* are provided with the hollow part 23*a* therebetween and hold the water absorber 24*a*. The first plate 21*b* and the second plate 22*b* are also not required to be in close contact with each other to cause the hollow part 23*b* to form a strong thermally insulated state, because the first and second plates 21*b* and 22*b* are provided with the hollow part 23*b* therebetween and hold the water absorber 24*b*.

The water absorbers 24*a* and 24*b* are formed of, for example, felt or flock. The water absorber 24*a* has a water absorption surface 26*a* exposed at the exposed portion 25*a* at an end portion of the second plate 22*a* on the downstream side, the end portion positioned on the downstream side of airflow of the end portion of the first plate 21*a* on the downstream side of airflow. The water absorber 24*b* has a water absorption surface 26*b* exposed at the exposed portion 25*b* at an end portion of the second plate 22*b* on the downstream side, the end portion positioned on the downstream side of airflow of the end portion of the first plate 21*b* on the downstream side of airflow. Each of the water absorbers 24*a* and 24*b* includes an adhesive material (not shown) or a double-sided tape (not shown) disposed on a back side of the water absorption surface 26*a* or 26*b* corresponding thereto. The water absorbers 24*a* and 24*b* are bonded to an adhesion surface 27*a* of the second plate 22*a* and to an adhesion surface 27*b* of the second plate 22*b*, respectively, via the adhesive material or the double-sided tape.

The water absorbers 24*a* and 24*b* may be bonded to the first plates 21*a* and 21*b*, respectively, instead of to the second plate 22*a* or 22*b*.

Next, the second up-down airflow direction louver 17 will be described in detail.

As illustrated in FIG. 5, during cooling operation, the second up-down airflow direction louver 17 comes into contact, on the side of the second plate 22*a*, with warm indoor air and comes into contact, on the side of the first plate 21*a*, with cool air that is heat exchanged by passing through the casing 1.

A portion of the water absorption surface 26*a* of the water absorber 24*a* is exposed to the side of the cool air on the side of the first plate 21*a*, the portion being positioned further to the downstream side of the airflow than a portion of the water absorber 24*a* held between the first plate 21*a* and the second plate 22*a*.

A distal end of the end portion of the second plate 22*a* on the downstream side is curved toward the side of the first plate 21*a*. The water absorber 24*a* can be bonded to the second plate 22*a* along the curved portion, which enables easy bonding of the water absorber 24*a*.

The distal end of the end portion of the second plate 22*a* on the downstream side need not be curved toward the side of the first plate 21*a*.

As illustrated in FIG. 3, the second up-down airflow direction louver 17 closes the air outlet 9 during non-operation and forms an aesthetic surface of a lower surface of the indoor unit 100 of the air-conditioning apparatus. Thus, the water absorption surface 26*a* of the water absorber 24*a* is bonded so as to face the side of the first plate 21*a*. As a result, the water absorber 24*a* is not exposed during non-operation, which enables the lower surface of the indoor unit 100 to have a simple appearance.

The second up-down airflow direction louver 17 may be formed to be inside-out such that the first plate 21*a* serves as the surface constituting the aesthetic surface of the lower surface of the indoor unit 100 of the air-conditioning apparatus during non-operation. In this case, the water absorber 24*a* is exposed on the aesthetic surface of the lower surface of the indoor unit 100 of the air-conditioning apparatus during non-operation.

Next, the third up-down airflow direction louver 18 will be described in detail.

As illustrated in FIG. 6, during cooling operation, the third up-down airflow direction louver 18 comes into contact, on the side of the first plate 21*b*, with the warm indoor air and comes into contact, on the side of the second plate 22*b*, with the cool air that is heat exchanged by passing through the casing 1.

A portion of the water absorption surface 26*b* of the water absorber 24*b* is exposed to the side of the warm indoor air on the side of the first plate 21*b*, the portion being positioned further to the downstream side of the airflow than a portion of the water absorber 24*b* held between the first plate 21*b* and the second plate 22*b*. Such a structure enables condensation water generated due to the warm air to be immediately absorbed by the water absorber 24*b*.

Adhesion surfaces for the water absorber 24*b* are at two positions, which are at the end portion of the second plate 22*b* on the downstream side and at a support portion 22*b*1 that protrudes from the second plate 22*b* toward the side of the first plate 21*a*. The water absorber 24*b* is bonded to the two adhesion surfaces, and the first plate 21*b* projects over the water absorber 24*b*.

The second plate 22*b* may be formed in such a manner that a gap between the end portion of the second plate 22*b* on the downstream side and the support portion 22*b*1 is filled with a resin. In addition, the adhesion surface 27*b* for the water absorber 24*b* may be on the side of the first plate 21*b*.

As illustrated in FIG. 3, the third up-down airflow direction louver 18 is stored inside the indoor unit 100 of the air-conditioning apparatus during non-operation.

Due to the second up-down airflow direction louver 17 and the third up-down airflow direction louver 18 having the above structures, when condensation occurs on the end portions on the downstream side of the airflow that passes along the second up-down airflow direction louver 17 and the third up-down airflow direction louver 18, condensation water is retained by the water absorbers 24*a* and 24*b* and prevented from dripping in a room.

Moreover, even when adhesives of the water absorbers 24*a* and 24*b* peel off, the water absorbers 24*a* and 24*b* do not come off from the second up-down airflow direction louver 17 or the third up-down airflow direction louver 18, because the water absorbers 24*a* and 24*b* are held between the first plate 21*a* and the second plate 22*a* and between the first plate 21*b* and the second plate 22*b*, respectively.

According to Embodiment 1 above, the indoor unit 100 of the air-conditioning apparatus includes the casing 1 having the upper air inlet 10, the front surface air inlet 14, and the air outlet 9 and including the heat exchanger 6 and the air-sending fan 7 disposed inside the casing 1. In addition, there are provided the second up-down airflow direction louver 17 and the third up-down airflow direction louver 18, which are disposed at the air outlet 9 and control the up-down direction of the air from the air outlet 9. The second up-down airflow direction louver 17 includes the first plate 21*a* and the second plate 22*a* joined to each other, and the third up-down airflow direction louver 18 includes the first plate 21*b* and the second plate 22*b* joined to each other. The second up-down airflow direction louver 17 and the third up-down airflow direction louver 18 include the water absorbers 24*a* and 24*b*, respectively, which are at the end portions corresponding thereto on the downstream side of the airflow that passes along the second up-down airflow direction louver 17 and the third up-down airflow direction louver 18. The water absorbers 24*a* and 24*b* are held between the first plate 21*a* and the second plate 22*a* and between the first plate 21*b* and the second plate 22*b*, respectively. The portion of the water absorber 24*a* and the portion of the water absorber 24*b* are exposed.

In the above structure, there are provided the water absorbers 24*a* and 24*b* at the end portions corresponding thereto on the downstream side of the airflow that passes along the second up-down airflow direction louver 17 and the third up-down airflow direction louver 18. The water absorbers 24*a* and 24*b* are held between the first plate 21*a* and the second plate 22*a* and between the first plate 21*b* and the second plate 22*b*, respectively. The portion of the water absorber 24*a* and the portion of the water absorber 24*b* are exposed. Due to such a structure, even when condensation occurs on the end portion of the second up-down airflow direction louver 17 on the downstream side or on the end portion of the third up-down airflow direction louver 18 on the downstream side, condensation water can be retained by the water absorber 24*a* or 24*b* and prevented from dripping in a room.

Moreover, because the water absorbers 24*a* and 24*b* are held between the first plate 21*a* and the second plate 22*a* and between the first plate 21*b* and the second plate 22*b*, respectively, the water absorbers 24*a* and 24*b* do not come off from the second up-down airflow direction louver 17 or from the third up-down airflow direction louver 18, which leads to high durability and high reliability.

Accordingly, it is possible to provide the highly reliable indoor unit 100 of the air-conditioning apparatus, which prevents condensation water from dripping from the end portions of the second up-down airflow direction louver 17 and the third up-down airflow direction louver 18 on the downstream side of the airflow.

The second up-down airflow direction louver 17 is formed by joining the first plate 21*a* and the second plate 22*a* to each other and providing the hollow part 23*a* therebetween, and the third up-down airflow direction louver 18 is formed by joining the first plate 21*b* and the second plate 22*b* to each other and providing the hollow part 23*b* therebetween.

Such a structure improves the heat insulation properties of the second up-down airflow direction louver 17 and the third up-down airflow direction louver 18 due to the hollow parts 23*a* and 23*b*, thereby preventing condensation from easily occurring on the end portions on the downstream side of the airflow that passes along the second up-down airflow direction louver 17 and the third up-down airflow direction louver 18.

At least a portion of a surface of the water absorber 24*a* opposite to the water absorption surface 26*a* thereof is bonded to one of the first plate 21*a* and the second plate 22*a*, and at least a portion of a surface of the water absorber 24*b* opposite to the water absorption surface 26*b* thereof is bonded to one of the first plate 21*b* and the second plate 22*b*.

In the above structure, the water absorbers 24*a* and 24*b* can be fixed by bonding.

During cooling operation, the third up-down airflow direction louver 18 comes into contact, on the side of the first plate 21*b*, with the warm indoor air and comes into contact, on the side of the second plate 22*b*, with the cool air that is heat exchanged by passing through the casing 1. The end portion of the second plate 22*b* on the downstream side is positioned on the downstream side of airflow of the end portion of the first plate 21*b* on the downstream side of airflow. A portion of the water absorption surface 26*b* of the water absorber 24*b* is exposed to the side of the warm indoor air, the portion being positioned further to the downstream side of the airflow than the portion of the water absorber 24*b* held between the first plate 21*b* and the second plate 22*b*.

Due to the above structure, condensation water generated on the side of the warm indoor air can be immediately retained by the water absorption surface 26*b* of the water absorber 24*b*.

REFERENCE SIGNS LIST

1 casing 2 back surface case 3 front surface panel 4 suction grille 5 side cover 6 heat exchanger 7 air-sending fan 8 drain pan 9 air outlet 10 upper air inlet 11 filter 12 upper cover 13 lower cover 14 front surface air inlet 15 left-right airflow direction louver 16 first up-down airflow direction louver 17 second up-down airflow direction louver 18 third up-down airflow direction louver 19 infrared sensor 21*a* first plate 21*b* first plate 22*a* second plate 22*b* second plate 22*b*1 support portion 23*a* hollow part 23*b* hollow part 24*a* water absorber 24*b* water absorber 25*a* exposed portion 25*b* exposed portion 26*a* water absorption surface 26*b* water absorption surface 27*a* adhesion surface 27*b* adhesion surface 100 indoor unit

The invention claimed is:

1. An indoor unit of an air-conditioning apparatus, the indoor unit comprising:

a casing having an air inlet and an air outlet and including a heat exchanger and an air-sending fan disposed inside the casing; and an up-down airflow direction louver disposed at the air outlet and controlling up-down airflow direction of air discharged from the air outlet, the up-down airflow direction louver including a first plate and a second plate joined to each other and a water absorber at an end portion of the up-down airflow direction louver on a downstream side of an airflow that passes along the up-down airflow direction louver, wherein an end portion of the second plate on the downstream side is positioned on the downstream side of the airflow of an end portion of the first plate on the downstream side, and the water absorber is held between the first plate and the second plate, the water absorber includes an exposed portion of a water absorption surface of the water absorber exposed between:

a covered portion of the water absorber held between the first plate and the second plate, and an end portion of the second plate on the downstream side.

2. The indoor unit of the air-conditioning apparatus of claim 1, wherein the up-down airflow direction louver includes a hollow space between the first plate and the second plate joined to each other.

3. The indoor unit of the air-conditioning apparatus of claim 1, wherein at least a portion of a surface of the water absorber opposite to the water absorption surface thereof is bonded to one of the first plate and the second plate.

4. The indoor unit of the air-conditioning apparatus of claim 1, wherein during a cooling operation of the indoor unit, the up-down airflow direction louver comes into contact with warm indoor air on a side of the first plate and comes into contact with cool air on a side of the second plate that is heat exchanged by passing through the casing, and a portion of the water absorption surface of the water absorber is exposed to the warm indoor air.

* * * * *